United States Patent [19]

Wheaton

[11] Patent Number: 4,470,888

[45] Date of Patent: Sep. 11, 1984

[54] METHOD FOR PREPARING ALKALI METAL CHLORATES BY ELECTROLYSIS

[75] Inventor: Gregory A. Wheaton, Swedesboro, N.J.

[73] Assignee: Pennwalt Corporation, Philadelphia, Pa.

[21] Appl. No.: 530,431

[22] Filed: Sep. 8, 1983

[51] Int. Cl.[3] ..... C25B 1/24

[52] U.S. Cl. ..... 204/95; 204/98; 204/128

[58] Field of Search ..... 204/95, 98, 128

[56] References Cited

U.S. PATENT DOCUMENTS

| | | | |
|---|---|---|---|
| 2,902,418 | 9/1959 | Burns | 204/98 |
| 2,982,608 | 5/1961 | Clement | 204/98 |
| 3,535,216 | 10/1970 | Grotheer et al. | 204/95 |
| 3,649,485 | 3/1972 | Chisholm | 204/95 |
| 3,979,276 | 9/1976 | Strain | 204/282 |
| 4,004,988 | 1/1977 | Mollard | 204/95 |
| 4,046,653 | 9/1977 | de Nora et al. | 204/95 |
| 4,086,150 | 4/1978 | Kindl et al. | 204/95 |
| 4,207,152 | 6/1980 | Kadija et al. | 204/98 |
| 4,339,312 | 7/1982 | Brooks et al. | 204/95 |

FOREIGN PATENT DOCUMENTS

| | | | |
|---|---|---|---|
| 7364 | of 1896 | United Kingdom | 204/95 |

*Primary Examiner*—R. L. Andrews
*Assistant Examiner*—Terryence Chapman

[57] ABSTRACT

In the preparation of alkali metal chlorates, an aqueous alkali metal chloride is electrolyzed in the presence of at least one additive chosen from among silicates, fluorides, polybasic hydroxyalkanoic acids or their alkali metal salts, and sulfides. The use of such additives improves the power efficiency of chlorate production by eliminating the disadvantageous effects caused by the presence of transition metals.

12 Claims, No Drawings

METHOD FOR PREPARING ALKALI METAL CHLORATES BY ELECTROLYSIS

BACKGROUND OF THE INVENTION

The present invention relates to an improvement in the manufacture of alkali metal chlorates by electrolysis, and more particularly to a means of reducing losses in power efficiency due to the adverse effects caused by the presence of transition metals such as copper, nickel, iron and manganese by adding effective amounts of silicates, fluorides, polybasic hydroxyalkanoic acids and their salts, and sulfides.

Alkali metal (M) chlorates are produced by the electrolysis of aqueous alkali metal chlorides in accordance with the overall chemical reaction:

$$MCl + 3H_2O \rightarrow MClO_3 + 3H_2$$

which consumes 6 faradays to produce a 1 gram-mole of alkali metal chlorate. The primary electrochemical reactions which occur during chlorate formation are assumed to be oxidation of chloride at the anode and reduction of water at the cathode as follows:

$$2Cl^- \rightarrow Cl_2 + 2e$$

$$2H_2O + 2e \rightarrow H_2 + 2OH^-$$

It is thought that chlorine generated at the anode is hydrolyzed to form hypochlorite which then reacts further to produce the chlorate as follows.

$$Cl_2 + H_2O \rightleftharpoons H^+ + Cl^- + HOCl$$

$$HOCl \rightleftharpoons H^+ + OCl^-$$

$$2HOCl + OCl^- \rightleftharpoons 2H^+ + 2Cl^- + ClO_3^-$$

The cell power efficiency during electrolytic manufacture of chlorates is adversely effected by a variety of factors including a number of parasitic reactions which occur concurrently with those which result in chlorate formation. Many of these parasitic reactions are characterized by the evolution of oxygen. Therefore, the concentration of oxygen in the cell effluent gas is generally considered to be one measure of power inefficiency. One parasitic reaction resulting in oxygen evolution is the decomposition of the intermediate hypochlorite in the bulk of the electrolyte as follows.

$$2HOCl \rightarrow 2H^+ + 2Cl^- + O_2$$

The rate of hypochlorite decomposition is greatly accelerated by transition metal cations, oxides, and/or hydroxides if they are present even at very low concentrations in the electrolyte. It is believed that the catalysis of hypochlorite decomposition by transition metal impurities contributes significantly to the production of oxygen and subsequent loss of power efficiency during electrolytic chlorate production.

A variety of innovations have appeared over the years directed at increasing the power efficiency in electrolytic chlorate manufacture. Salts containing oxyanions of hexavalent chromium have been added to the electrolyte and are used in conventional technology to inhibit the corrosion of steel cathodes and the cathodic reduction of hypochlorite and chlorate. A combination of sodium dichromate and molybdic acid have been added to the electrolyte during chlorate manufacture to achieve the same results using a greatly reduced concentration of hexavalent chromium, which causes problems in product purification and waste water treatment. Phosphorus-containing complexing agents have been added to the electrolyte to complex alkaline earth metal cations to reduce the buildup of scale deposits on metal cathodes permitting longer periods of uninterrupted satisfactory cell operation.

SUMMARY OF THE INVENTION

I have now developed a method whereby the disadvantageous effects caused by the presence of cations, oxides, and/or hydroxides of transition metals as impurities in the electrolyte during electrolytic production of alkali metal chlorates, particularly the acceleration of oxygen production by decomposition of the intermediate hypochlorite, may be eliminated, or at least, minimized.

In accordance with this invention, there is provided a method for manufacturing alkali metal chlorates with an improved power efficiency comprising electrolyzing an aqueous solution of an alkali metal chloride in the presence of at least one additive selected from the group consisting of silicates, fluorides, polybasic hydroxyalkanoic acids or their alkali metal salts, and sulfides.

DETAILED DESCRIPTION OF THE INVENTION

The additives which can be used in the method of the present invention are chosen from among silicates, fluorides, polybasic hydroxyalkanoic acids and their alkali metal salts, and sulfides. These additives may be used singly or in combination. The use of silicates is preferred either singly or in combination with at least one other additive. The use of silicates alone is especially preferred.

The term "silicate" as used herein designates discrete or extended silicate compounds, including orthosilicates having the general formula $M_4SiO_4$, condensed noncyclic silicates having the general formula $M_{2n+2}Si_nO_{3n+1}$, and metasilicates having the general formula $M_{2n}Si_nO_{3n}$ wherein M is hydrogen or an alkali metal and n is an integer equal to or greater than one and preferably from one to three. Thus, the silicate additive to the electrolyte may be illustratively, sodium orthosilicate ($Na_4SiO_4$) potassium orthosilicate ($K_4SiO_4$), sodium pyrosilicate ($Na_6Si_2O_7$), potassium pyrosilicate ($K_6Si_2O_7$), tetrasodium dilithium pyrosilicate ($Na_4Li_2Si_2O_7$), silicic acid ($H_2SiO_3$), sodium metasilicate ($Na_2SiO_3$), potassium metasilicate ($K_2SiO_3$), lithium metasilicate ($Li_2SiO_3$), sodium metadisilicate ($Na_4Si_2O_6$), potassium metatrisilicate ($K_6Si_3O_9$), or sodium metahexasilicate ($Na_{12}Si_6O_{18}$).

The term "fluoride" as used herein designates compounds having either the formula MF where M is hydrogen or an alkali metal or the formula $MHF_2$ where M is an alkali metal. Thus, the fluorine-containing additive to the electrolyte may be, illustratively, hydrogen fluoride (HF), sodium fluoride (NaF), or sodium bifluoride ($NaHF_2$).

The term "polybasic hydroxyalkanoic acid" as used herein designates compounds which are polybasic alkanoic acids, or their alkali metal salts, containing a total of one to six carbon atoms and which have at least one hydroxy-substituent. Thus the polybasic hydroxyalkanoic acid additive to the electrolyte may be, illustratively hydroxymalonic acid ($HO_2CCHOHCO_2H$), tartaric acid ($HO_2CCHOHCHOHCO_2H$), citric acid $HO_2CCH_2C(CO_2H)OHCH_2CO_2H$, monosodium citrate $NaO_2CH_2COH(CO_2H)CH_2CO_2H$, or trisodium citrate $NaO_2CCH_2(CO_2Na)CH_2CO_2Na$.

The term "sulfide" as used herein designates compounds having the formula $M_2S_n$ where M is hydrogen or an alkali metal or mixtures thereof and n is an integer equal to or greater than one and preferably one to two. Thus the sulfur containing additive to the electrolyte may be, illustratively, hydrogen sulfide ($H_2S$), sodium hydrosulfide (NaSH), sodium sulfide ($Na_2S$), or sodium bisulfide ($Na_2S_2$).

The mechanism whereby these additives operate to reduce the rate of oxygen production due to hypochlorite decomposition is not completely understood. It is not simply a matter of precipitating soluble transition metal cations since the additives are equally effective at eliminating the adverse effects of insoluble transition metal oxides and/or hydroxide impurities suspended in the electrolyte. The additives can be used in the presence of alkali metal dichromates or chromates and do not interfere with the advantageous effects of these compounds in the electrolyte.

The additives used in the process of this invention can be added in any sequence to the electrolyte medium. Thus they can be added to the water used to dissolve the alkali metal chloride or they can be added to the aqueous mother liquor or electrolyte bath containing alkali metal chloride, alkali metal chlorate and conventional small amounts of anticorrosive adjuvants such as dichromates. They can also be added to the electrolysis cells and the associated equipment such as pipes, storage containers, and other apparatus through which the electrolyte passes during the process of chlorate manufacture. The additives may also be used in aqueous solution in a separate treatment or passivation step apart from the actual production of chlorate in order to complex or otherwise react with transition metal impurities which may have become deposited by precipitation or coprecipitation or otherwise immobilized within the system. Such separate treatment is considered to be within the scope of the invention. The additives may also be formed in situ within the electrolyte from precursor substances which are convertible to the additives by chemical or electrolytic steps such as oxidation at the anodes or by chemical means. Illustrative of silicon compounds thus capable of generating silicates under the conditions of the electrolytic production of alkali metal chlorates are hydrous silica ($SiO_2.XH_2O$), and silanes ($H_mSiX_{4-m}$) where X is halogen (Cl, Br, I) and m is an integer from zero to four.

The effective amount of additive used according to the method of this invention can be from about 1.0 to 100 times the concentration stoichiometrically equivalent to the transition metal concentration. The amount of additive will generally range from about 5 to about 20,000 ppm in the solution (0.005 to 20 grams per kilogram of solution). The concentration of additive to be employed in the electrolyte will vary with the additive used. In general, as a guidance to adjusting the amount of additive to be used, the electrolyte and any insoluble suspended deposits are analyzed for transition metal cations and minor adjustments to optimize performance are made empirically while holding the several parameters of electrolysis constant, such as temperature, which can be from about 25° C. to 100° C. and preferably from about 35° C. to 85° C.; pH, which can be from about 5 to 10; current density; and anode identity. Using the preferred silicate additive, the preferred concentration of additive in the electrolyte is from about 2 to 12 times the concentration stoichiometrically equivalent to the transition metal concentration. This is generally in the range of from about 10 to 500 ppm.

The variables of concentration, pH, temperature, current density, and the several other electrolysis parameters are statistically interactive. The optimum combination of these variables can be determined by statistical analysis of controlled experiments to obtain the desired balance of operating parameters.

In practicing the method of this invention the preferred alkali metal chlorate produced by electrolysis of an aqueous solution of alkali metal chlorate is sodium chlorate manufactured by electrolysis of an aqueous solution of sodium chloride. In practicing the method of this invention it is preferred that when any additive added to the electrolyte contains an alkali metal that alkali metal be sodium. It is especially preferred that the additive to be added to the electrolyte containing sodium chloride and sodium chlorate be sodium metasilicate. Other alkali metal chlorates, such as potassium chlorate, can be manufactured by the method of this invention and it is preferred, although not necessary, that when any additive added to the electrolyte contains an alkali metal that alkali metal be the same as in contained in the alkali metal chlorate produced.

The following comparative tests A, B, and C illustrate the deleterious effects of the presence of transition metal cation, oxide and/or hydroxide impurities in the electrolyte, especially with regard to oxygen evolution by the chemical decomposition of hypochlorite.

TEST A

A mixture of 30 mls of distilled water which had been saturated with sodium chloride and 30 mls of an alkaline commercial bleach solution containing 5.25 percent by weight sodium hypochlorite was mechanically stirred in a flask equipped with a thermometer and a pH electrode. The flask was connected to a eudiometer which was partially submerged in a water bath by which the volume of oxygen evolved could be measured. The flask containing the aqueous sodium chloride and bleah mixture was immersed in a thermostatically controlled oil bath and heated to 63°–64° C. with vigorous stirring. Over the course of one hour, the average rate of oxygen evolution corrected to 25° C. and 1 atmosphere pressure was 0.024 ml/min.

TEST B

The procedure of Test A was repeated except that a 1 ml portion of a solution of 0.099 percent by weight nickel (II), as the chloride salt, in distilled water was added to the flask. Upon heating at 63°–64° C. for ten minutes with vigorous stirring, the average rate of oxygen evolution was 20.80 mls/min.

TEST C

The procedure of Test A was repeated except that 4.90 grams of a sludge, which has been deposited on the bottom of an operating chlorate electrolysis cell, composed primarily of iron oxides $Fe_2O_3$ and $Fe_3O_4$ and containing small amounts of calcium, chromium, copper, manganese, and nickel was added to the flask. Upon heating this mixture at 64°–65° C. for one hour with vigorous stirring to suspend the solid sludge the average rate of oxygen evolution was observed to be 4.250 mls/min.

As shown by the above three tests, transition metal impurities, regardless of whether these impurities be present in the form of soluble transition metal cations or as insoluble, precipitated oxides and/or hydroxides, or mixtures thereof, significantly increase the rate at which oxygen is evolved from the hypochlorite-containing electrolyte.

The effectiveness of the additives used in the method of this invention for eliminating the disadvantageous effects of transition metal impurities, specifically the acceleration of oxygen production from an electrolyte solution containing hypochlorite at elevated temperatures, is illustrated by but is not intended to be limited to, the following examples. The apparatus used in these examples is the same as that used in Test A to measure the rate of oxygen production. The term "sludge" as used in the following examples designates the deposited material used in Test C.

EXAMPLE 1

To a slurry of about 96 grams of the sludge in about 950 grams of saturated aqueous sodium chloride solution was added 1.9 percent by weight, (with respect to the combined weight of the sludge and aqueous sodium chloride solution) of sodium metasilicate ($Na_2SiO_3$) with vigorous stirring. Portions of the resulting slurry containing about 5.0 grams of suspended sludge (about 40 mls of slurry) were taken at various times and placed in the flask of the apparatus used in Test A. The slurry of sludge was heated to 64°-65° C., and 30 mls of alkaline commercial bleach solution containing about 5.56 percent by weight of sodium hypochlorite was added to the flask. The resulting mixture was heated with stirring at 64°-65° C. and the rate of oxygen production was measured for one hour. The results over a 14 day period are shown in Table I below:

TABLE I

| Run | Time after addition of $Na_2SiO_3$ to sludge slurry (hrs) | Average rate of oxygen evolution (mls/min) |
|---|---|---|
| 1 | 0.1 | 0.133 |
| 2 | 70 | 0.117 |
| 3 | 94 | 0.089 |
| 4 | 170 | 0.114 |
| 5 | 264 | 0.127 |
| 6 | 300 | 0.112 |
| 7 | 340 | 0.133 |

EXAMPLE 2

To the mixture of commercial bleach solution and sludge slurry treated with sodium metasilicate for 300 hours used in Run 6 of Example 1 was added, at 64°-65° C. with vigorous stirring, a 1.0 ml portion of the solution of nickel (II) chloride used in Test B. Over the course of one hour after addition of the nickel solution, the average rate of oxygen evolution was 0.342 ml/min.

EXAMPLE 3

To demonstrate the in situ formation of sodium metasilicate the treatment of a slurry of sludge in saturated aqueous sodium chloride of Example 1 was repeated except that the sodium metasilicate was replaced by 1.0 percent by weight of either silicic acid or silica, as a colloidal aqueous suspension (LUDOX® SM, technical grade; 17.2% solids; obtained from E. I. duPont de Nemours & Co., Inc). After standing for 120 hours at room temperature, 40 ml portions of the treated sludge slurries were combined with 30 mls of commercial bleach solution as in Test A and heated for one hour at 64°-65° C. The results are shown in Table II below:

TABLE II

| $Na_2SiO_3$ Precursor | Ave. Rate of Oxygen Evolution (mls/min) |
|---|---|
| Silicic acid | 0.201 |
| Colloidal Silica (LUDOX ®) SM) | 0.164 |

EXAMPLE 4

To 40 mls of a slurry of sludge in saturated aqueous sodium chloride solution in the flask of the apparatus used in Test A was added 4.78 percent by weight of sodium fluoride. After stirring at 23° C. for one hour, this mixture was heated to 64°-65° C., 30 mls of commercial bleach solution was added to the flask, and oxygen evolution was measured over the course of one hour. The average rate of oxygen evolution was 2.660 mls/min.

EXAMPLE 5

The procedure of Example 4 was repeated except that the sodium fluoride was replaced by 2.00 percent by weight of hydrofluoric acid, added as a 49 percent by weight aqueous solution in small portions at 25° C. over a 2½ hour period. Over the course of one hour the average rate of oxygen evolution was 0.394 mls/min at 64°-65° C.

EXAMPLE 6

The procedure of Example 4 was repeated except that the sodium fluoride was replaced by 1.00 percent by weight of anhydrous citric acid. Over the course of 75 minutes the average rate of oxygen evolution was 0.947 mls/min.

EXAMPLE 7

The procedure of Example 4 was repeated except that the sodium fluoride was replaced by 2.91 percent by weight of sodium sulfide. Over the course of 90 minutes the average rate oxygen evolution was 1.000 mls/min.

EXAMPLE 8

The practice of the method of this invention in the chlorate manufacturing process is illustrated by the following example.

A plant-scale electrolytic production of sodium chlorate was carried out in a plant-prototype electrolysis cell wherein the aqueous electrolyte composition varied within the following levels.

| | grams/liter |
|---|---|
| Sodium chloride | 100 to 150 |
| Sodium chlorate | 400 to 600 |
| Sodium hypochlorite | 1 to 3 |
| Sodium dichromate | 2 to 6 |

The electrolyte entering the cell contained about 9 ppm iron, about 2 ppm calcium; and about 1 ppm each of copper, manganese and nickel. The pH of the electrolyte entering the cell was maintained at about 5.5 to 6.0. The electrolysis was carried out at 79°-82° C. using a current of 38,000 to 40,000 amperes at a cell potential of about 3 volts. According to the method of this invention, there was continuously added, as a 5 percent by weight aqueous solution, about 0.05 to 0.30 grams of sodium metasilicate per kilogram of electrolyte solution entering the cell.

Prior to addition of the sodium metasilicate in the practice of the method of this invention, sodium chlorate was produced with a power efficiency of about 90% as calculated using the method of Jaksic, et al, based on the analysis of the gas stream produced during the electrolysis.

$$\text{Chlorate efficiency} = \frac{100 - 3(\%\ O_2) - (\%\ Cl_2)}{100 - \%\ O_2 - \%\ Cl_2}$$

Upon commencement of the addition of sodium metasilicate according to the method of this invention, the concentration of oxygen present in the gas stream produced during the electrolysis rapidly decreased by about 12 relative percent and was maintained at this level. After commencement of the addition of sodium metasilicate according to the method of this invention sodium chlorate was produced with the power efficiency rising to 94.5%.

Having disclosed this invention, it is apparent to those skilled in the art that modifications may be made which do not depart from the spirit of this invention. The specific examples presented in this disclosure are illustrative of the invention and are not intended to be limitations upon the true scope of the invention.

I claim:

1. A process for the production of an alkali metal chlorate which comprises electrolyzing an aqueous solution of alkali metal chloride in an electrolytic cell at a temperature of from about 25° to 100° C. and a pH between about 5 and 10 in the presence of at least one additive selected from the group consisting of alkali metal silicates, fluorides, polybasic hydroxyalkanoic acids or their alkali metal salts, and sulfides in a concentration at least stoichiometrically equivalent to the concentration of transition metals present.

2. The process of claim 1 in which the concentration of the additive is from about 1 to 100 times the concentration stoichiometrically equivalent to the concentration of transition metals present.

3. The process of claim 2 in which the additive is a fluoride in a concentration of up to about 5,000 ppm.

4. The process of claim 3 in which the additive is hydrogen fluoride.

5. The process of claim 2 in which the additive is a polybasic hydroxyalkanoic acid in a concentration of up to about 10,000 ppm.

6. The process of claim 5 in which the additive is citric acid.

7. The process of claim 2 in which the additive is a sulfide in a concentration up to about 20,000 ppm.

8. The process of claim 7 in which the additive is sodium sulfide.

9. The process of claim 1 in which the concentration of the additive in the solution is from about 5 to 10,000 ppm.

10. The process of claim 1 in which the additive is sodium metasilicate in a concentration of up to about 500 ppm.

11. The process of claim 1 in which the alkali metal chlorate produced is sodium chlorate.

12. The process of claim 1 in which the alkali metal chlorate produced is potassium chlorate.

* * * * *